US006450382B1

(12) United States Patent
Ohno

(10) Patent No.: US 6,450,382 B1
(45) Date of Patent: Sep. 17, 2002

(54) PRINTING WEB POSITION ADJUSTING APPARATUS

(75) Inventor: Kinichiro Ohno, Tokyo (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 8 days.

(21) Appl. No.: 09/722,746

(22) Filed: Nov. 28, 2000

(30) Foreign Application Priority Data

Jan. 5, 2000 (JP) ..... 2000-000464

(51) Int. Cl.[7] ..... B65H 43/08; B65H 23/24; B65H 23/32

(52) U.S. Cl. ..... 226/21; 226/22; 226/23; 242/615.12; 242/615.21

(58) Field of Search ..... 226/21, 22, 23; 242/615.12, 615.21

(56) References Cited

U.S. PATENT DOCUMENTS

| | | | | | |
|---|---|---|---|---|---|
| 2,513,927 | A | * | 7/1950 | Farrington | 226/23 |
| 3,326,435 | A | * | 6/1967 | Shelton | 226/22 |
| 3,373,288 | A | * | 3/1968 | Otepka et al. | 226/21 X |
| 3,411,683 | A | * | 11/1968 | Bartles et al. | 226/21 |
| 4,342,412 | A | * | 8/1982 | Lorenz et al. | 226/21 |
| 4,848,632 | A | * | 7/1989 | Mack et al. | 226/21 X |
| 4,991,761 | A | | 2/1991 | Gnuechtel et al. | |
| 5,308,010 | A | * | 5/1994 | Hakiel | 226/21 X |
| 5,520,317 | A | * | 5/1996 | Eckert et al. | 226/21 |
| 5,667,123 | A | * | 9/1997 | Fukuda | 226/21 |
| 5,823,464 | A | * | 10/1998 | Bohn et al. | 242/615.21 |
| 6,164,201 | A | * | 12/2000 | Burke | 226/21 X |

FOREIGN PATENT DOCUMENTS

| | | |
|---|---|---|
| JP | 52-10226 | 7/1973 |
| JP | 6-29108 | 2/1992 |
| JP | 2743200 | 6/1998 |

OTHER PUBLICATIONS

English Language Abstract of JP 6–29108.

* cited by examiner

*Primary Examiner*—Kathy Matecki
*Assistant Examiner*—Minh-Chau Pham
(74) *Attorney, Agent, or Firm*—Greenblum & Bernstein, P.L.C.

(57) ABSTRACT

The problem to be solved by this invention is a conventional printing web position adjusting apparatus poses a problem in which angularly displacing means having excellent accuracy is difficult to install, large power is needed, fabrication cost is high, an adjustment result cannot be detected since a side edge position is detected on an inlet side of the apparatus and space saving cannot be achieved. A printing web position adjusting apparatus for adjusting a side edge position of printing web to a previously,determined position based on an output signal of an edge sensor provided on a downstream side of the apparatus by angularly displacing integrally two of guide bars provided between two guide rollers orthogonal to a travelling direction of printing web and in parallel with each other and respectively having different angular displacement centers arranged such that printing web is made to wrap over substantially 180 degree of peripheral faces thereof while maintaining parallelism therebetween.

10 Claims, 8 Drawing Sheets

PRINTING WEB POSITION ADJUSTING APPARATUS

BACKGROUND OF THE INVENTION

1. Field of the Invention

The present invention relates to a printing web position adjusting apparatus capable of adjusting a side edge position and a position in a travelling direction, that is, cutoff position, of printing web travelling in a rotary press.

2. Description of the Related Art

As apparatus for adjusting a side edge position of printing web travelling in a rotary press, for example, apparatus disclosed in Japanese Patent Publication No. Hei 6-29108 and Japanese Patent No. 2743200 are publicly known.

First, the apparatus disclosed in Japanese Patent Publication No. Hei 6-29108 is constituted by upstream side and downstream side fixed guides provided in parallel with each other at an interval of a certain distance therebetween in a travelling direction of printing web (hereinafter, may be referred to as "two fixed guides") and upstream side and downstream side guide bars provided at an interval of a certain distance therebetween in the travelling direction of the printing web (hereinafter, may be referred to as "two guide bars"). The guide bar on the upstream side is arranged on the upstream side of the fixed guide on the upstream side and at a position shifted upwardly by a sum of respective radii thereof, further, the guide bar on the downstream side is arranged on the downstream side of the fixed guide on the downstream side and at a position shifted upwardly by a sum of respective radii thereof.

By the constitution, the printing web passes to wrap on the respective fixed guides and the respective guide bars respectively over substantially 180 degree from the fixed guide on the upstream side to the fixed guide on the downstream side.

The two fixed guides are rotatably supported by frames provided on both sides in parallel with each other in the travelling direction of the printing web. Further, the two guide bars are supported by auxiliary frames provided on both sides in parallel with each other in the travelling direction of the printing web. By angularly displacing the auxiliary frames centering on fulcrums provided on the other side frame, the two guide bars are angularly displaced integrally with each other, thereby, adjustment of the side edge position of the printing web is carried out.

Next, according to the apparatus disclosed in Japanese Patent No. 2743200, a pair of side frames (fixedly supporting frames) are rotatably provided with a lower roller on the upstream side and a lower roller on the downstream side which are provided in parallel with each other at an interval of a certain distance therebetween in a travelling direction of printing web, further, on inner sides of the pair of side frames, there are provided a pair of auxiliary frames (pivotable frames) rotatably supporting an upper roller on the upstream side and an upper roller on the downstream side which are provided in parallel with each other at an interval of a certain distance therebetween in the traveling direction of the printing web. The lower roller on the upstream side is arranged on the lower side of the upper roller on the upstream side remotely therefrom, further, the lower roller on the downstream side is arranged on the lower side of the upper roller remotely therefrom.

By the constitution, the printing web passes to wrap on the respective upper rollers and the respective lower rollers respectively over substantially 90 degree from the lower roller on the upstream side to the lower roller on the downstream side.

Further, the pair of side frames are provided with a pivotable beam supporting the auxiliary frames, a stay (supporting horizontal member) supporting the pivotable beam and having a rotational center of pivoting thereof and a drive mechanism for driving the pivotable beam. By the drive mechanism, a side edge position of the printing web is adjusted by pivoting the auxiliary frames to thereby provide a certain angle to the upper roller on the upstream side and the upper roller on the downstream side with regard to a width direction of the printing web.

Further, there are provided a detecting apparatus having a sensor for detecting a displacement of the printing web in a transverse direction at a position of a longitudinal edge portion thereof, (that is, a displacement of side edge position) and generating an error signal at a vicinity of the lower roller on the upstream side, a correcting apparatus for correcting a position of the printing web at the longitudinal edge portion (side edge position) by pivoting the pivotable beam by a percentage equal to or lower than 100% of a pivotable limit of the pivotable beam, an apparatus of setting cautionary movement points constituting a pivotable upper limit and a pivotable lower limit at positions of percentages within a range of 100% of a total of a maximum pivotable displacement and a control,apparatus for generating a feedback signal when the displacement of the pivotable beam exceeds the cautionary movement points and correcting to adjust the position of the longitudinal edge portion (side edge position) of the printing web by roll stands of a paper feeding unit.

In the meantime, as an apparatus of adjusting a cutoff position, for example, an apparatus disclosed in Japanese Patent Publication No. Sho 52-10226 is publicly known. The apparatus is provided with a guide roller arranged such that printing web is made to wrap on the guide roller over substantially 180 degree of a peripheral face thereof and movably in parallel with the printing web in a travelling direction of the printing web which is made to wrap thereon by substantially 180 degree in a travelling path of the printing web and the cutoff position is adjusted by moving the guide roller in parallel with the travelling direction of the printing web to thereby change a travelling path length of the printing web.

Among the above-described publicly-known technologies, according to the apparatus disclosed in Japanese Patent Publication No. Hei 6-29108, when it is known that the travelling position of the printing web is shifted in the width direction, a hand-wheel provided at the frame on one side is rotated, and a machine frame (the above-described auxiliary frame) supporting a pair of movable guides is angularly displaced by an angle in accordance with a shift in the clockwise direction or the counterclockwise direction centering on the fulcrums provided at a vicinity of the frame on the other side.

Thereby, the shift in the width direction of the printing web is corrected and the printing web is returned to a predetermined travelling position.

However, at the frame on one side, the auxiliary frame is moved in a shape of a circular arc and accordingly, it is difficult to accurately install a member supporting the auxiliary frame and sticking or play is liable to cause. When the sticking or play is caused, there poses a problem in which much force is required in angularly displacing the auxiliary frame by rotating the hand-wheel.

Further, since there is constructed a structure in which the central point of the angular displacement of the auxiliary frame is provided at a vicinity of the frame on the other side and the auxiliary frame is supported by the pair of guide bars, in view of maintaining mechanical strength and accuracy, the auxiliary frame is necessarily constituted by a large-sized member, as a result, even in the case in which power is supplied in angularly displacing the auxiliary frame, large power is needed.

Further, with regard to printing web both faces of which are printed, abrasion is caused between the printing web and the movable guides and accordingly, there poses a problem in which print face is contaminated.

In the meantime, according to the apparatus disclosed in Japanese Patent No. 2743200, when the pivotable beam supporting the two movable rollers is angularly displaced, a portion of the pivotable beam remote from the central point of the angular displacement significantly protrudes on both sides of the stay and support of the pivotable beam by the stay becomes unstable. Therefore, not only operation of adjusting the side edge position of the printing web becomes difficult but also travelling of the printing web per se becomes unstable, as a result, there poses a problem in which adjustment of the side edge position cannot be carried out sufficiently.

Further, since there is carried out a control of adjusting the side edge position by providing a pair of sensors in the width direction of the printing web at an entry side of the web guide apparatus (that is, a vicinity of an upstream side of the lower roller on the upstream side constituting the travelling path of the printing web) and detecting the position of the edge portion in the longitudinal direction of the printing web (side edge position), there poses a problem in which the result of adjustment by the web guide apparatus cannot be detected.

Further, since there are provided the correcting apparatus, the apparatus offsetting cautionary movement points and the control apparatus for generating a signal when the displacement of the pivotal beam exceeds the cautionary movement points and correcting the position of the longitudinal edge portion (side edge position) of the printing web by the roll stands of the paper feeding unit, control and operation are doubled, the efficiency of operation of controlling the side edge position of the printing web is significantly deteriorated, further, the above-described amounts to an increase in the cost of fabricating the adjusting apparatus of this kind.

In the meantime, by the tendency of multiple color formation and multiple page formation of a rotary press in recent years, many facilities are concentrated on peripheries of a printing unit and a folding unit for realizing the multiple color formation and the multiple page formation and saving of space is ardently requested. Particularly, at a travelling path of the printing web from the printing unit to the folding unit, due to a necessity of adjusting a cut position of the printing web at the folding unit, a compensator roller apparatus (refer to FIG. 11) is provided and accordingly restriction of space is severe and it is extremely difficult to install to add the printing web The compensator roller apparatus is for adjusting a length of a travelling path of the printing web and is constituted by an inlet side guide roller 82 (82*a*), a compensator roller 84 and an outlet side guide roller 83 in the traveling path of the printing web as shown by FIG. 11. The inlet side guide roller 82 guides printing web 21 to the compensator roller 84 on the downstream side. The compensator roller 84 provided movably in parallel with the traveling direction of the printing web 21, changes the traveling direction of the printing web by 180 degrees, guides the printing web to the outlet side guide roller 83 on the downstream side, further, the direction of the printing web is changed by the outlet side guide roller 83 again by 180 degrees to thereby return the traveling direction of the printing web to the original direction. By moving the compensator roller 84 in parallel with the traveling direction, in the case in which the printing web is cut at the folding unit on the downstream side, the cut position (cutoff position) is adjusted such that the printing web is prevented from being cut at a printed portion (printed image).

The present invention resides in providing an apparatus of adjusting a side edge position of traveling printing web resolving the above-described problems. Specifically, as follows.

A first object of the present invention resides in providing a printing web side edge position adjusting apparatus having a concise, simple and light-weighted mechanical constitution and smooth operation which is difficult to cause sticking or play.

A second object of the present invention resides in providing a printing web side edge position adjusting apparatus in which a constitution of control means is concise and control operation is swift and accurate.

A third object of the present invention resides in being capable of installing easily a mechanism capable of carrying out adjustment of a side edge position of printing web and adjustment of cutoff thereof between a printing unit and a folding unit while achieving space saving formation of facilities from the printing unit to the folding unit by adding a cutoff position adjusting function having a compensator roller apparatus in a printing web position adjusting apparatus.

A fourth object of the present invention resides in reducing or avoiding contamination of printing web caused by contact and abrasion between the printing web and guide bars which is produced when printing web both faces of which are printed passes through a printing web position adjusting apparatus.

SUMMARY OF THE INVENTION

In order to achieve the above-described object, the present invention is provided with a constitution, as a basic constitution, including:

- two guide rollers provided orthogonally to a travelling direction of printing web and in parallel with each other; two guide bars disposed between the two guide rollers in a travelling path of the printing web, arranged such that the printing web from the guide roller on an upstream side of the travelling path of the printing web to the guide roller on a downstream side thereof, is made to wrap on peripheral faces of the respective guide rollers over substantially 180 degree and provided angularly displaceably in a plane in parallel with face of the travelling printing web respectively by separate angular displacement centers;
- angularly displacing means for angularly displacing the two guide bars integrally with each other while maintaining parallelism therebetween;
- an edge sensor disposed further downstream from the guide roller on the downstream side in the travelling path of the printing web such that a side edge position of the travelling printing web can be detected; and
- control means for controlling operation of the angularly displacing means such that the side edge position of the printing web is adjusted to a previously determined position based on an output signal of the edge sensor.

Further, in order to achieve the above-described object, in addition to the above-described basic constitution, there is constructed a constitution in which at least one of the two guide rollers is provided reciprocally movably in parallel with the travelling direction of the printing web.

Further, in order to achieve the above-described object, there is constructed a constitution in which central portions of the two guide bars are made hollow and provided with small holes reaching hollow portions thereof at outer peripheral faces thereof on which the printing web is made to wrap, further comprising air supplying means for supplying compressed air to the hollow portions of the guide bars.

DESCRIPTION OF THE PREFERRED EMBODIMENTS

Figure 1:
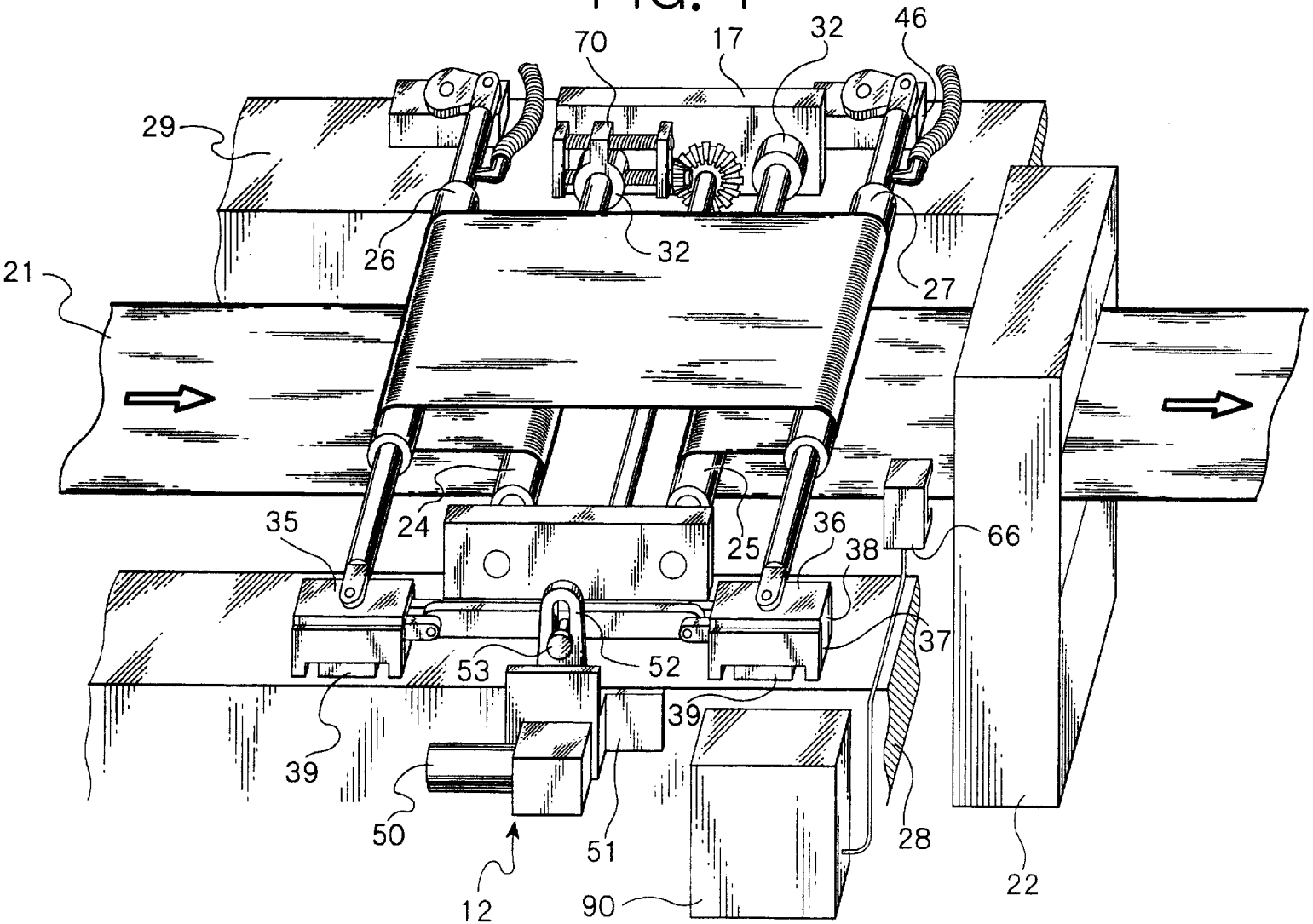
FIG. 1 is a perspective: view showing an embodiment in which the present invention is embodied in an offset rotary press.
Figure 2:
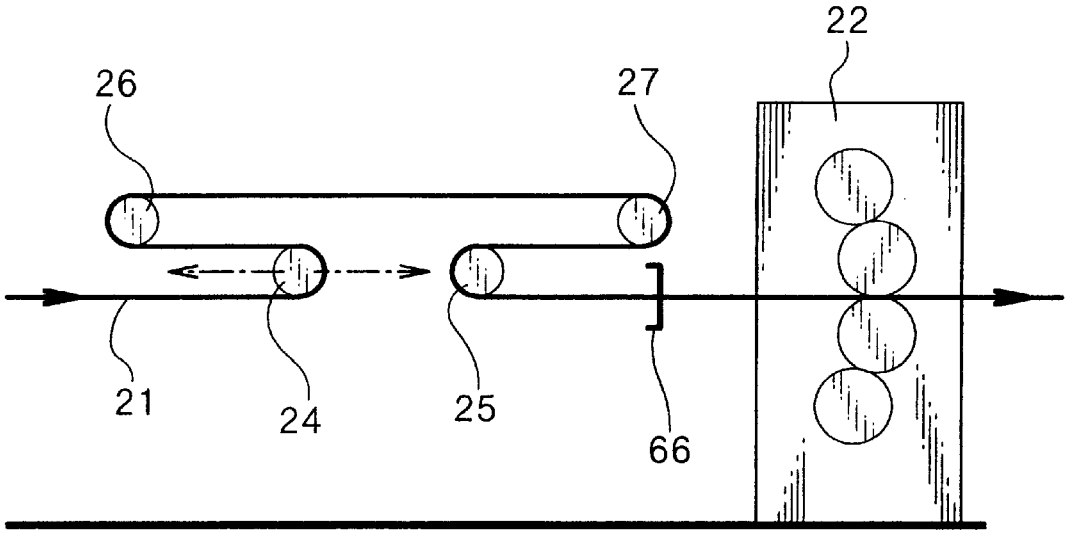
FIG. 2 is an outline side view of the embodiment shown by FIG. 1.
Figure 12:
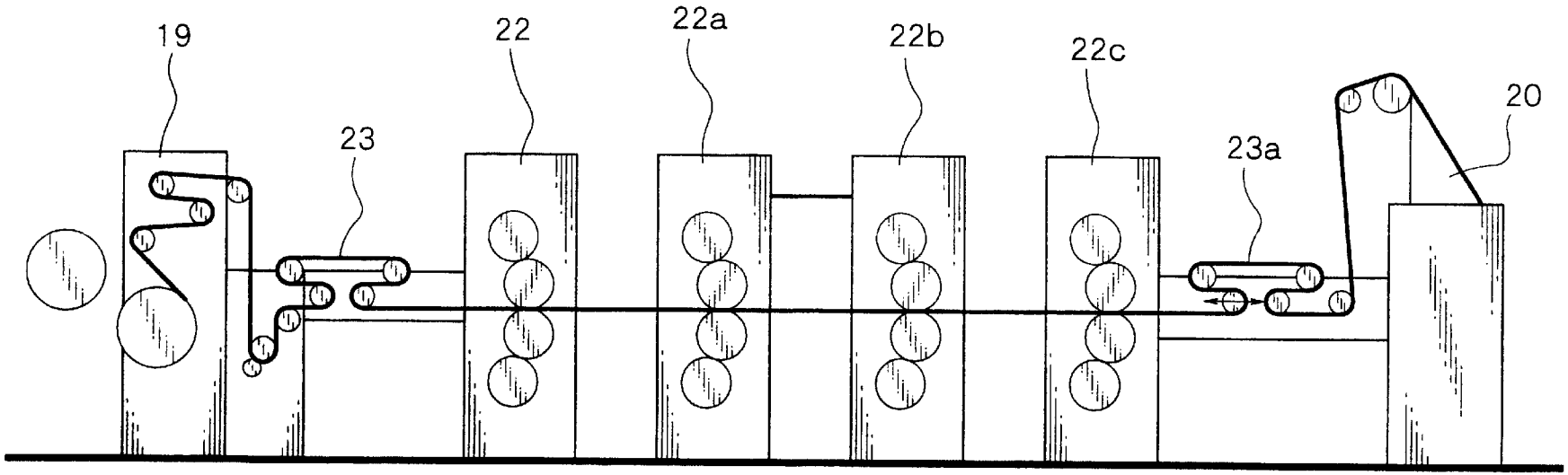
FIG. 12 is an outline total view showing an embodiment in which the present invention is embodied in an offset rotary press.

An explanation will be given of embodiments according to the present invention in reference to the drawings. FIG. 12 shows a total view of an embodiment in which the present invention is embodied in so-to-speak B—B type offset rotary press. Further, FIG. 1 and FIG. 2 show a further detailed embodiment of the present invention. FIG. 1 is a perspective view showing a total constitution of the present invention and FIG. 2 is an outline side view thereof.

As shown by FIG. 12, the printing web 21 travelled from a paper feeding unit 19 is adjusted to move in a width direction of the printing web by a printing web position adjusting apparatus 23 provided on the upstream side of a printing unit 22 such that a center line (a line equally dividing a width direction) of the printing web 21 conforms to a printing center and is guided into the printing unit 22.

Further, the printing web 21 printed with picture patterns at printing units 22, 22*a*, 22*b* and 22*c*, is adjusted to move in the width direction by a printing web position adjusting apparatus 23*a* provided on the upstream side of a folding unit 20 such that the printing center conforms to a folding line center and is guided into the folding unit 20.

The printing web position adjusting apparatus 23 and 23*a* are arranged on the upstream side of a portion at which a width direction position of the printing web needs to adjust in the travelling path of the line of the rotary press. According to the embodiment, these are used on the upstream side of the printing unit 22 and the upstream side of the folding unit 20. Further, at the printing web position adjusting apparatus 23 provided on the upstream side of the printing unit 22, the compensator roller function is not needed and accordingly, a guide roller 24 is not moved.

Figure 3:
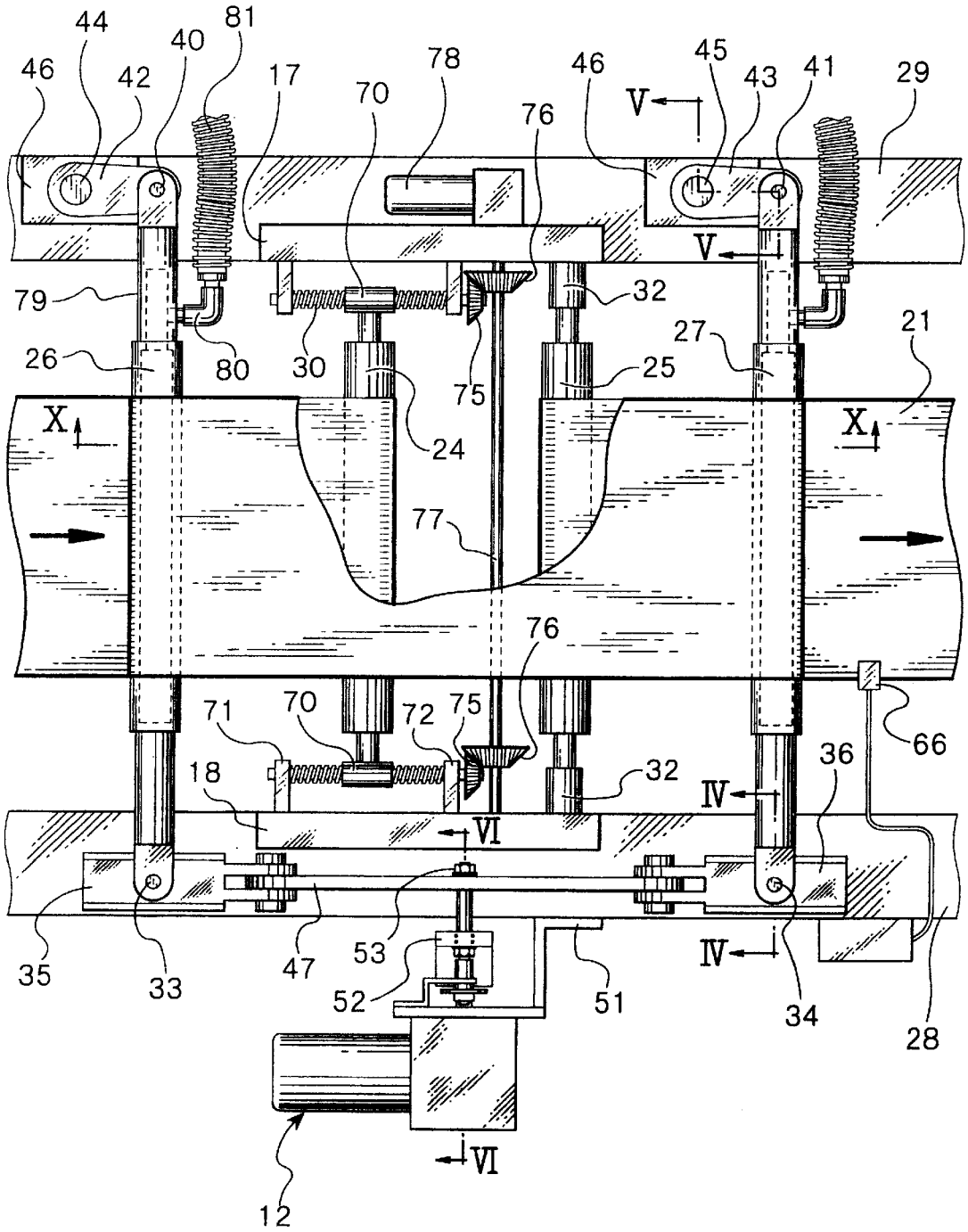
FIG. 3 is a plane view showing essential portions of the embodiment shown by FIG. 1.

As shown by FIG. 1 through FIG. 3, the guide roller 24 on one side and a guide roller on the other side are arranged orthogonally to the travelling direction of the printing web 21 and arranged in parallel with each other at an interval of a distance therebetween in the travelling direction. As shown by FIG. 3, the guide roller 24 on one side are rotatably supported by moving brackets 70 reciprocatable in parallel with the travelling direction of the printing web 21 via screw shafts 30. The guide roller, 25 on the other side is also rotatably supported via bearings 32 and is installed at frames 28 and 29.

Further, the guide roller 24 on one side is used as a compensator roller for adjusting a travelling path length such that a cut position (cutoff position) of the printing web 21 which is cut after printing is disposed at a proper position by reciprocally moving in parallel with the travelling direction of the printing web.

As shown by FIG. 1 through FIG. 3, a guide bar 26 on the upstream side and a guide bar 27 on the downstream side are arranged in parallel with each other at an interval of a distance therebetween in the travelling direction of the printing web 21 to dispose between the two guide rollers 24 and 25 in the travelling path of the printing web 21 and are arranged such that the printing web 21 is made to wrap on peripheral faces of the respective guide rollers 24 and 25 over substantially 180 degree.

Figure 4:
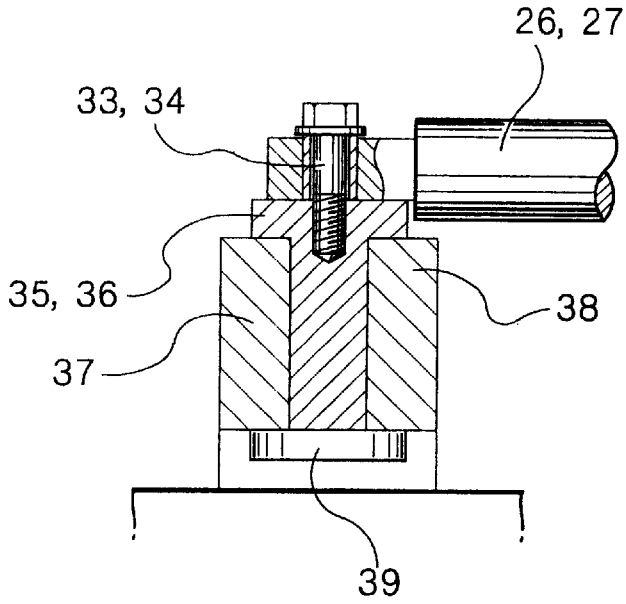
FIG. 4 is a sectional view taken along a line IV—IV of FIG. 3.

As shown by FIG. 3, one end portion of each of the guide bars 26 and 27 is connected to an angularly displacing means 12. That is, the one end portions of the guide bars 26 and 27 are attached angularly displaceably to moving pieces 35 and 36 by pins 33 and 34 respectively (FIG. 4) and the moving pieces 35 and 36 are connected. integrally with each other and are slidably supported in parallel with the travelling direction of the printing web 21 by brackets 37 and 38. Further, plate members 39 are attached to bottom portions of the moving pieces 35 and 36 respctively and are slidably brought into contact with bottom portions of the brackets 37 and 38 to thereby prevent the moving pieces 35 and 36 from being floated up. Further, the mechanism comprising the moving pieces 35 and 36, the brackets 37 and 38 and the plate members 39 may be replaced by a publicly-known linear guide.

Figure 5:
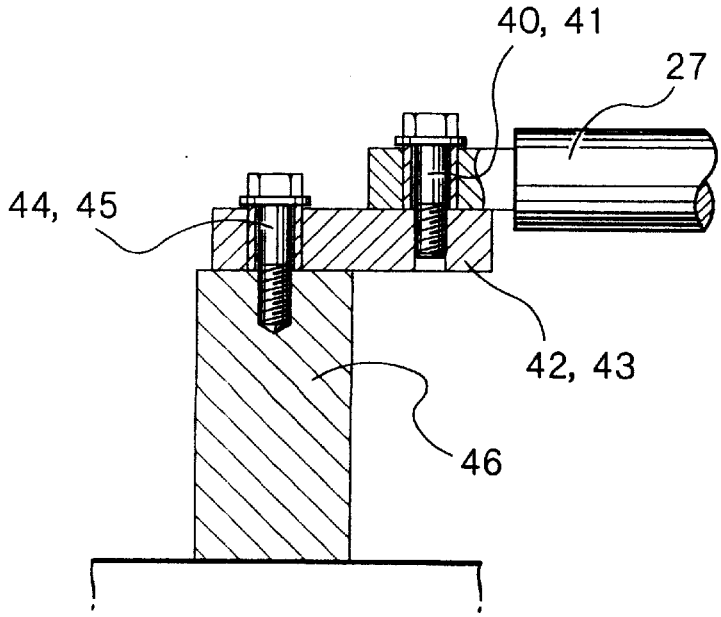
FIG. 5 is a sectional view taken along a line V—V of FIG. 3.

The other end portions of the guide bars 26 and 27 are respectively attached angularly displaceably to arms 42 and 43 by pins 40 and 41 and the arms 42 and 43 are respectively attached angularly displaceably to brackets 46 by pins 44 and 45 (FIG. 3, FIG. 5).

As described above, the guide bars 26 and 27 are provided with respectively separate centers of angular displacement and there are formed link mechanisms comprising the arms 42 and 43, the moving pieces 35 and 36 and a connecting member 47 and accordingly, by linearly moving the moving pieces 35 and 36 in parallel with the travelling direction of the printing web, while a parallelism is maintained between the guide bars 26 and 27, pertinent angular displacement is produced centering on a direction orthogonal to the travelling direction of the printing web (FIG. 3).

As shown by FIG. 1 and FIG. 3, the frame 28 on one side is provided with a motor 50 having a speed reduction gear and a brake via a bracket 51. One end of an arm 52 is attached to a rotating shaft of the motor 50 having a speed reduction gear and a brake and a long hole is provided at the other end of the arm 52 in its longitudinal direction.

The other end portion of the arm 52 is connected to the connecting member 47 via a pin 53 penetrating the long hole. When the motor 50 having a reduction gear and a brake is rotated, the arm 52 is rotated and the moving pieces 35 and 36 are slid in the travelling direction of the printing web via the pin 53.

Therefore, by rotating the rotating shaft of the motor 50 having a speed reduction gear and a brake, the moving pieces 35 and 36 are moved in the same direction (that is printing web travelling direction) by the same amount, as a result, the guide bars 26 and 27 are angularly displaced in the same direction by the same amount while maintaining parallelism with each other.

Further, according to the invention, as mentioned later, the case in which the guide bars 26 and 27 are in a direction orthogonal to the printing web travelling direction, constitutes an initial set position, that is, a regular position of angular displacement.

As shown by FIG. 1 and FIG. 3, in the travelling path of the printing web 21, there is provided an edge sensor 66 on the downstream side of the guide roller 25 on the downstream side of the printing web position adjusting apparatus 23.

The edge sensor 66 will do so far as the edge sensor 66 can detect the side edge position of the printing web and its constitution comprises, for example, a light projector and a light receiver, light flux having an area disposed at the side edge portion of the printing web 21 is projected and the light flux is caught by the receiver and an output signal in accordance with the position of the side edge portion of the printing web is transmitted to control means 90. The edge sensor 66 of this type is well known. Further, light may not necessarily be used for detecting the side edge position and other physical amount may be measured so far as an output signal in accordance with the side edge position of the printing web may be provided.

Figure 6:
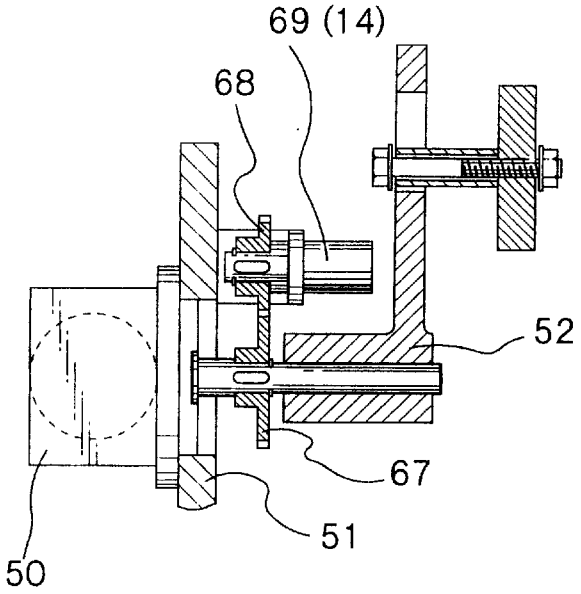
FIG. 6 is a sectional view taken along a line VI—VI of FIG. 3.

Further, as shown by FIG. 6, the motor 50 having a reduction gear and a brake is attached with displacement detecting means 14 for detecting a displacement of angularly displacing means via gears 67 and 68, for example, a potentiometer 69 for detecting a current angular displacement state.

When the current angular displacement state is detected, the signal is used for determining an operational range of the angularly displacing means 12. That is, according to the control means 90, a neutral point (initial set position) of the arm 52 is set to a point of outputting an output signal of a middle value of the potentiometer 69 and there are set two points of a point of a maximum value and a vicinity of point 0 within the operational range of the potentiometer 69. When the arm 52 reaches either, of the two points, in the control means 90, a stop signal is outputted predominantly to all other control and the motor 50 having a reduction gear and a brake is stopped.

Further, in place of the motor 50 having a reduction gear and a brake, a pulse motor may be used. In this case, the operational range of the angularly displacing means 12 may be determined by contact between both ends of the long hole of the arm 52 of the angularly displacing means 12 and the pin 53. That is, the both ends of the long hole of the arm 52 correspond to the point of the maximum value and the 0 point and the pulse motor is stopped by being brought into out of phase at these points. Therefore, in this case, the potentiometer 69 which is the operational amount detecting means 14 may not necessarily be needed.

As shown by FIG. 3, both ends of the guide roller 24 on the upstream side which can be used as a compensator roller are rotatably attached to the moving brackets 70 respectively. The inner side of a frame 18 on one side is fixed with guide rods in parallel with the travelling direction of the printing web (not illustrated in FIG. 3) by brackets 71 and 72 and rotatably attached with the screw shaft 30 in parallel with the guide rods.

The moving bracket 70 is attached movably to the guide rods and in screw coupling with the screw shaft 30 and accordingly, by rotating the screw shaft 30 to the right or to the left, the moving bracket 70 can be reciprocally moved in parallel with the travelling direction of the printing web. The inner side of a frame 17 on the other side is provided with a similar structure and by rotating the screw shaft 30 to the right or to the left, the moving bracket 70 can be reciprocated in parallel with the travelling direction of the printing web.

One end of each of the screw shafts 30 is respectively provided with a bevel gear 75 and bevel gears 76 in mesh with the respective bevel gears 75 are respectively provided on a shaft 77. Therefore, rotation of the respective screw shafts 30 is mechanically synchronized.

Further, a motor 78 having a speed reduction gear and a brake for driving the shaft 77 is installed on the outer side of the frame 17 on the other side. Therefore, by rotating the shaft 77 by the motor 78 having a speed reduction gear and a brake, the moving brackets 70 are moved at the same time, in the same direction and by the same amount, as a result, the guide roller 24 on the upstream side is reciprocally moved in parallel with the travelling direction of the printing web 21 while maintaining a state in parallel with the guide roller 25 on the downstream side.

Figure 10:
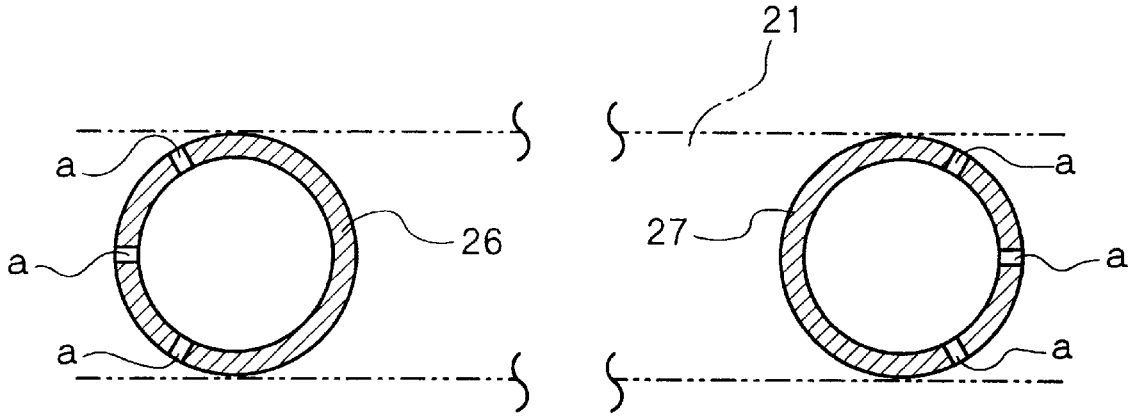
FIG. 10 is a sectional view taken along a line X—X of FIG. 3.
Figure 11:
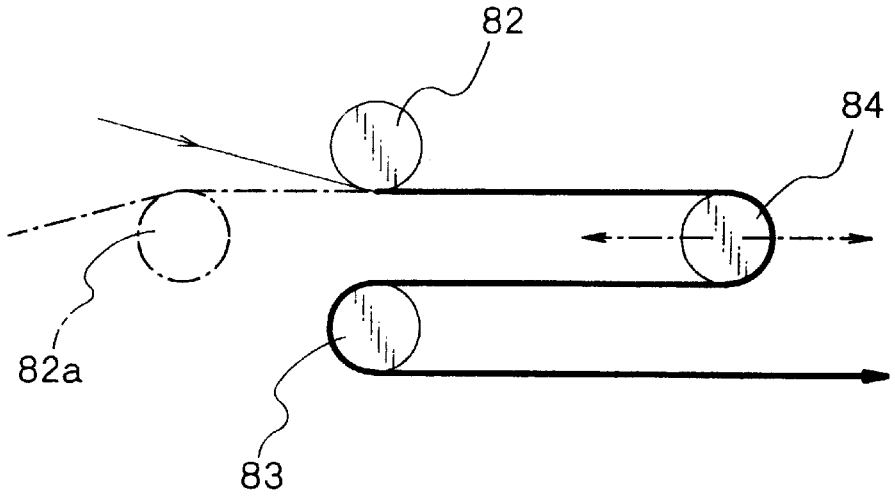
FIG. 11 is an outline side view showing a mode of a compensator roller.

As shown by FIG. 10, the guide bars 26 and 27 with which the travelling printing web 21 is brought into contact, constitute tubular bodies and are provided with hollow portions. Small holes "a" constituting a number of air injecting holes are provided on outer peripheral faces of the guide bars 26 and 27 with which the printing web 21 is brought into contact. Bonding members 79 bonded to the hollow potions of the guide bars 26 and 27 are also provided with hollow portions and the hollow portions of both are connected with each other. Further, the bonding members 79 are connected to flexible pipes 81 via joints 80 and are connected to a supply source (not illustrated) of compressed gas under pressure at at least equal to or larger than the atmospheric pressure, for example, compressed air.

By the constitution, air is injected from the small holes "a" of the guide bars 26 and 27 to the printing web 21 which is made to wrap on the guide bars 26 and 27 and the direction of which is changed and accordingly, press force of the printing web 21 on the guide bars 26 and 27 is reduced and frictional resistance produced between the printing web 21 and the guide bars 26 and 27 is alleviated.

Operation in the constitution of the present invention, described above, is as follows.

As shown by FIG. 2, the printing web 21 passes in an order of the upstream side guide roller 24, the upstream side guide bar 26, the downstream side guide bar 27 and the downstream side guide roller 25. Thereby, the printing web 21 is made to wrap on the two guide bars 26 and 27 over substantially 180 degree.

Figure 7:
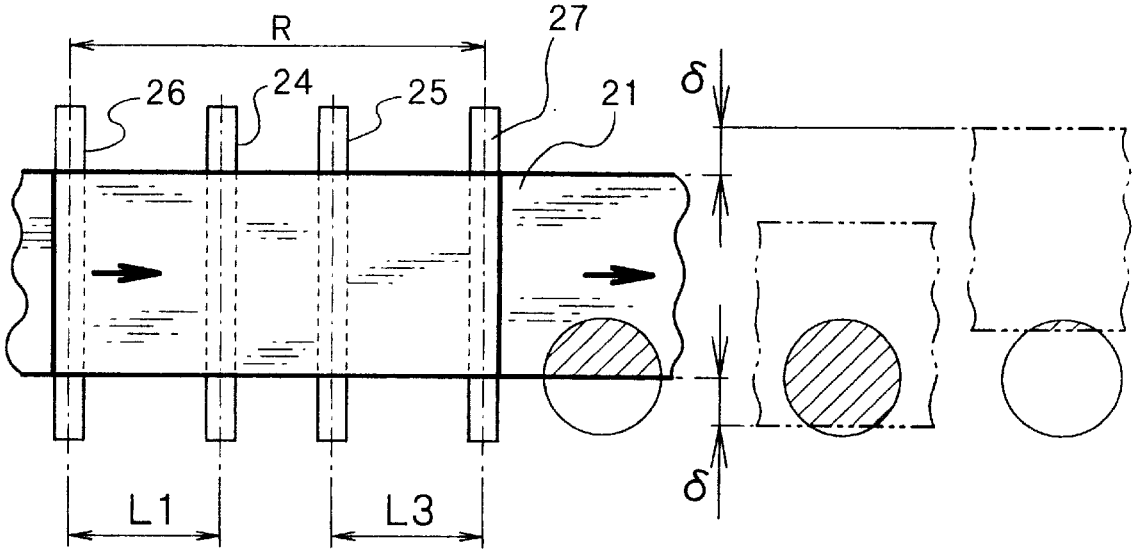
FIG. 7 is a plane view showing states of printing web, respective guide rollers and respective guide bars at regular positions (when adjustment is not needed).

FIG. 7 shows a state (regular position) in which the guide bars 26 and 27 are set orthogonally to the travelling direction of the printing web 21 and in this case, on the upstream side of the guide roller 24 on the upstream side and on the downstream side of the guide roller 25 on the down stream side, the travelling direction of the printing web 21 and the side edge position of the printing web 21 in travelling coincide with each other.

In contrast thereto, similarly as shown by FIG. 7, there is a case in which the side edge position of the printing web is shifted to one side in the width direction by δ or shifted on the other side by δ. In this case, adjustment of the side edge position is needed.

The side edge position of the printing web 21 in travelling is detected by the edge sensor 66 on further downstream side of the guide roller 25 on the down stream side in the travelling path of the printing web. That is, a change in the side edge position is outputted from the edge sensor to the control means 90 as a signal in correspondence with a change in a light receiving amount of the light receiver.

According to the control means 90, when light flux caught by the light receiver of the edge sensor 66 in the case in which for example, the travelling position of the printing web 21 is at a regular position (case which does not need adjustment) as a previously determined position, constitutes, for example, ½ of a circle (half circle), by comparing the signal in correspondence with the light receiving amount of the light flux caught by the light receiver with the signal of the half circle, the control means 90 carries out a feedback control. That is, a direction in which the two guide bars 26 and 27 is to be angularly displaced is determined such that the side edge position of the printing web returns to the regular position, a rotation instruction signal of the motor 50 having a speed reduction gear and a brake is outputted and the travelling position is corrected. As a method of the feedback control, for example, there is PID control as a well-known method.

Figure 8:
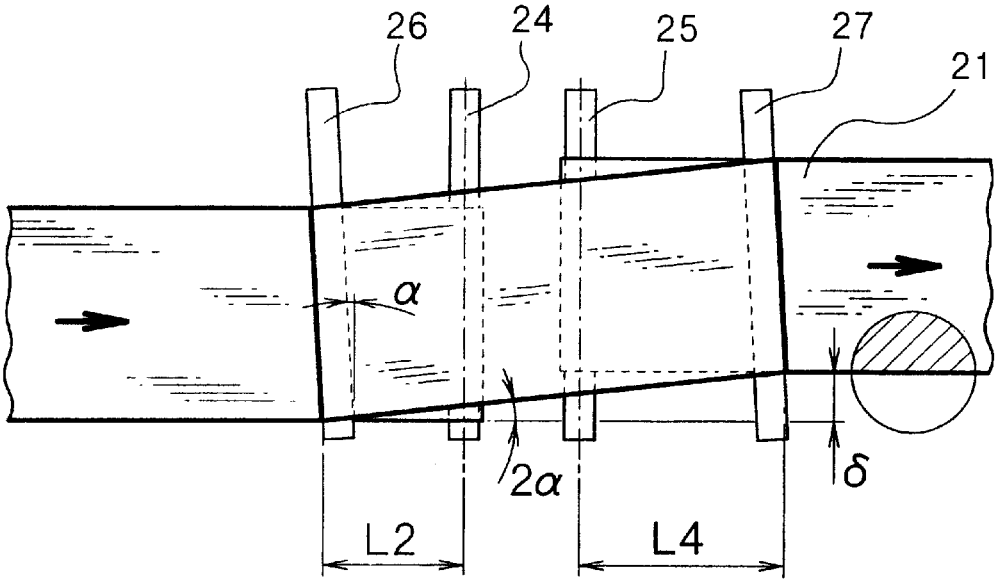
FIG. 8 is a plane view showing states of the printing web, the respective guide rollers and the respective guide bars when the apparatus is adjusted to the left side.

That is, in the illustrated embodiment, when the light flux caught by the light receiver is smaller than the half circle and the light receiving amount of the light receiver is smaller than the light receiving amount in the case in which the printing web 21 travels at the regular position, as shown by FIG. 8, the guide bars 26 and 27 are angularly displaced in the counterclockwise direction and the direction of the printing web 21 is changed in an upper direction of FIG. 8 by δ.

Figure 9:
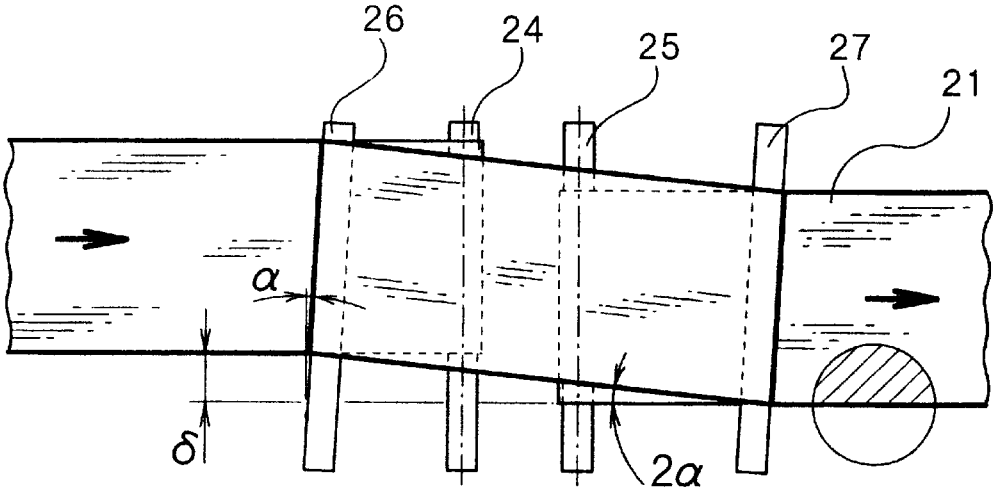
FIG. 9 is a plane view showing states of the printing web, the respective guide rollers and the respective guide bars when the apparatus is adjusted to the right side.

Further, when the light flux caught by the light receiver is larger than the half circle and the light receiving amount of the light receiver is larger than that in the case in which the printing web 21 travels at the regular position, as shown by FIG. 9, the guide bars 26 and 27 are angularly displaced in the clockwise direction and the direction of the printing web 21 is change in a downward direction of FIG. 9 by δ.

According to the angular displacement of the guide bars 26 and 27, by rotating the rotating shaft of the motor 50 having a speed reduction gear and a brake based on the rotation instruction signal, the moving pieces 35 and 36 are moved in the same direction via the arm 52 and the pin 53, as a result, the guide bars 26 and 27 are displaced in the same direction by the same angular amount while maintaining the parallelism.

The potentiometer attached to the rotating shaft of the motor 50 having a speed reduction gear and a brake outputs a signal in accordance with the angular displacement amount of the arm 52 to the control means 90. Further, the control means 90 carries out a control such that regular rotation and reverse rotation of the motor 50 having a speed reduction gear and a brake are permitted only between the two predetermined values (that is, previously determined small value and large value) of the output signal of the potentiometer 69 to stop the motor 50 having a speed reduction gear and a brake such that the operational range is not exceeded.

By constituting such a concise control, a number of processes of control of the control means 90, is reduced and therefore, the control operation becomes swift. Further, since the constitution of the control means 90 is made concise, an inexpensive printing web position adjusting apparatus can be provided.

When the edge sensor 66 is operated, the output signal with regard to the side edge position of the travelling printing web 21 is transmitted to the control means 90 and the control means 90 outputs a travelling position correcting signal of the printing web 21, the following operation is carried out to move the printing web 21 on the downstream side of the guide roller 25 on the downstream side in the width direction when the printing web 21 is travelling.

That is, the motor 50 having a speed reduction gear and a brake is rotated, the arm 52 is displaced angularly in one direction and the moving pieces 35 and 36 in the integrated state connected to the other end portion of the connecting member 47 via the pin 53 are moved to one side via the pin 53 at the other end portion of the arm 52. The moving pieces 35 and 36 are supported by upper faces of the brackets 37 and 38, movement in up and down direction thereof is restricted by the plate members 39, further, the moving pieces 35 and 36 are sandwiched by side faces of the brackets 37 and 38 and movement thereof orthogonal to the travelling direction of the printing web 21 is restricted. Therefore, even when the moving pieces 35 and 36 are slid in a direction in parallel with the travelling direction of the printing web 21, sticking or play is not produced, and the movement is smooth and accurate.

The guide bars 26 and 27 are connected to the arms 42 and 43 via the pins 40 and 41 and accordingly, in moving the moving pieces 35 and 36, the arms 42 and 43 are angularly displaced in accordance with the angular displacement of the guide bars 26 and 27 and the link mechanisms are constituted as a whole and accordingly, the guide bars 26 and 27 can be angularly displaced by the same amount while maintaining the parallelism therebetween. displaced in the counterclockwise direction, as shown by FIG. 8, the printing web 21 travels while moving the travelling position to the left side from the upstream side to the downstream side in the travelling direction of the printing web. Further, conversely, when the guide bars 26 and 27 are angularly displaced in the clockwise direction, as shown by FIG. 9, the printing web 21 travels while moving the travelling position to the right side from the upstream side to the downstream side in the travelling direction of the printing web.

Specifically, as shown by FIG. 8 and FIG. 9, by angularly displacing the guide bars 26 and 27 relative to the travelling direction of the printing web by α from the orthogonal direction, when the printing web 21 passes the movable guide 26 on the upstream side, the travelling direction is changed by an angle of 2α relative to the travelling direction of the printing web 21 and when the printing web 21 passes the movable guide 27 on the downstream side, the travelling direction of the printing web 21 is again changed by an angle of 2α relative to the travelling direction to a direction reverse to that in passing the guide bar 26.

At this occasion, since the two guide bars 26 and 27 are in parallel with each other, the travelling direction of the printing web 21 on the downstream side of the guide bar 26 on the upstream side, coincides with the travelling direction of the printing web 21 on the upstream side of the guide bar 26 on the upstream side and the side edge position of the travelling printing web 21 is parallelly moved by a movement amount δ which is changed between the guide bar 26 on the upstream side and the guide bar 27 on the downstream side (that is, side edge position adjustment amount δ).

In this case, when a distance between the guide bar 26 on the upstream side and the guide bar 27 on the downstream side is designated by notation R, the following equation is established.

$$\delta=(\tan 2\alpha)\times R$$

That is, when the guide bars 26 and 27 are displaced from the orthogonal state shown by FIG. 7, as shown by FIG. 8, for example, a distance between the guide roller 24 on the upstream side at the side edge portion of the printing web 21 on this side, is changed as L1→L2 (where L1>L2) and a distance between the guide roller 25 on the downstream side and the guide bar 27 on the downstream side, is changed as L3→L4 (where L3>L4), by angularly displacing the guide bars 26 and 27 in parallel with the printing web 21 between the guide rollers and the guide bars, (L1+L3)=(L2+L4) is established, and even when the guide bars 26 and 27 are displaced, the distance between the guide roller 24 on the upstream side and the guide roller 25 on the downstream side remains unchanged. This goes the same with the other side edge portion of the printing web 21 and in sum, even when the guide bars 26 and 27 are angularly displaced, a length of the printing web 21 at any position thereof in the width direction travelling while being guided by these, is not changed but remains the same.

When the printing web 21 travels at the regular position, the edge sensor 66 outputs a signal in correspondence therewith to the control means 90. The control means 90 inputted with the signal outputs a stop instruction signal (travelling position correcting signal) of the motor 50 having a reduction gear and a brake and the motor 50 having a reduction gear and a brake is stopped.

According to the present invention, the guide bars 26 and 27 are supported at four points of the brackets 46 via the arms 42 and 43 on the other frame side and the moving pieces 35 and 36 on the one frame Side and accordingly, load can be distributed, and in comparison with the supporting system by the auxiliary frames as in the conventional example, the supporting system can be considerably small-sized and light-weighted. Therefore, power for driving the angularly displacing means 12 can be reduced.

Further, there can be saved large-sized parts of the supporting stay or the auxiliary frame forming the rotational center of the auxiliary frame provided from the one frame to the other frame and there is achieved an effect of reducing the fabrication cost.

Further, according to the illustrated embodiment, compressed air is supplied from an air supply source (not illustrated) to inside of the pair of guide bars 26 and 27 via the flexible pipes 81, the joints 80 and the bonding members 79 and air layers can be formed between the outer peripheral faces of the guide bars 26 and 27 and the printing web 21 by injecting air from the small holes "a" constituting air injecting ports provided at the outer peripheral faces of the guide bars 26 and 27. Thereby, contamination caused by abrasion between the printing web 21 the both faces of which are printed and the guide bars 26 and 27 can be reduced or avoided.

Although according to the above-described embodiments, the potentiometer is used as the displacement detecting means, there may be used detecting means outputting a signal in correspondence with a rotational angle and accordingly, a rotary encoder may be used. Further, although the motor having a speed reduction gear and a brake is used as a drive source of the angularly displacing means, a servo motor may be used.

Further, the present invention is not limited to the above-described embodiments but includes modifications and change in view of design.

By carrying out the present invention, load is distributedly supported by using the link mechanisms and accordingly, there can be saved large-sized parts of a supporting stay, an auxiliary frame and so on provided from one frame to other frame, a mechanical constitution of the apparatus is made concise and simple and since weight of parts moved by angular displacement is significantly reduced, required power can be reduced.

Further, by using the link mechanism, the apparatus is displaced linearly in a direction in parallel with a travelling direction of printing web and accordingly, mechanical error in movement is made extremely small and the operation can be made smooth.

Further, an edge sensor is installed on an outlet side of the printing web position adjusting apparatus and therefore, the feedback control can be carried out after knowing a result of adjustment. Further, the processing by the control means is simple and therefore, swift control can be carried out, the cost of the control means and accordingly, the fabrication cost of a total of the apparatus can also be reduced.

Further, according to the invention, by enabling to move at least one of the guide rollers in a direction in parallel with the travelling direction of the printing web, a travelling path length of the printing web can be adjusted, thereby, in comparison with the case in which both of the compensator roller apparatus and the printing web position adjusting apparatus are installed between the printing unit and the folding unit, space saving formation can be realized. As a result, in the case in which the printing web position adjusting apparatus is installed between the printing unit and the folding unit, the installation is facilitated in a technical view point and an economic view point by an amount of alleviating restriction in view of space.

Further, contamination caused by abrasion between printing web both faces of which are printed and guide bars can be reduced or avoided and the problem involved in the conventional technology can be resolved.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A printing web position adjusting apparatus for adjusting a side edge position of a printing web traveling in a rotary press, said printing web position adjusting apparatus comprising:

two guide rollers provided orthogonally to a traveling direction in a traveling path of the printing web and parallel to each other, one of said guide rollers on an upstream side of the traveling path and the other of said guide rollers on a downstream side of the traveling path;

two guide bars disposed between said two guide rollers in the traveling path of the printing web and arranged such that the printing web traveling from said guide roller on the upstream side of the traveling path of the printing web to said guide roller on the downstream side thereof is made to wrap on a peripheral face of each said guide roller over substantially 180 degrees, said two guide bars being angularly displaceable in a plane parallel to the traveling direction of the printing web around separate angular displacement centers;

angular displacing means for angularly displacing said two guide bars integrally with each other around said separate angular displacement centers while maintaining parallelism therebetween;

an edge sensor disposed farther downstream from said guide roller on the downstream side in the traveling path of the printing web such that a side edge position of the traveling printing web can be detected; and control means for controlling operation of said angular displacing means such that the side edge position of the printing web is adjusted to a previously determined position based on an output signal of said edge sensor.

2. The printing web position adjusting apparatus according to claim 1, wherein at least one of said two guide rollers is reciprocally movable parallel to the traveling direction of the printing web.

3. The printing web position adjusting apparatus according to claim 2, wherein central portions of said two guide bars are hollow and are provided with small holes reaching hollow portions thereof at outer peripheral faces thereof on which the printing web is made to wrap, further comprising air supplying means for supplying compressed air to said hollow portions of said guide bars.

4. The printing web position adjusting apparatus according to claim 1, wherein central portions of said two guide bars are hollow and are provided with small holes reaching hollow portions thereof at outer peripheral faces thereof on which the printing web is made to wrap, further comprising air supplying means for supplying compressed air to said hollow portions of said guide bars.

5. A printing web position adjusting apparatus for adjusting a side edge position of a traveling printing web, said printing web position adjusting apparatus comprising:

two guide rollers disposed orthogonally to a traveling direction in a traveling path of the printing web and parallel to each other, one of said guide rollers on an upstream side of the traveling path and the other of said guide rollers on a downstream side of the traveling path;

two guide bars disposed between said two guide rollers in the traveling path of the printing web and arranged such that the printing web traveling from said guide roller on the upstream side of the traveling path of the printing web to said guide roller on the downstream side thereof is made to wrap on a peripheral face of each said guide roller over substantially 180 degrees, said two guide bars being angularly movable in a plane parallel to the traveling direction of the printing web around separate angular movement centers;

a mover that angularly moves said two guide bars integrally with each other around said separate angular movement centers while maintaining parallelism therebetween;

an edge sensor disposed downstream from said guide roller on the downstream side in the traveling path of the printing web such that a side edge position of the traveling printing web can be detected; and a controller that controls operation of said mover such that the side edge position of the printing web is adjusted to a previously determined position based on an output signal of said edge sensor.

6. The printing web position adjusting apparatus according to claim 5, wherein at least one of said two guide rollers is reciprocally movable parallel to the traveling direction of the printing web.

7. The printing web position adjusting apparatus according to claim 6, wherein central portions of said two guide bars are hollow and are provided with small holes reaching hollow portions thereof at outer peripheral faces thereof on which the printing web is made to wrap, further comprising an air supplier that supplies compressed air to said hollow portions of said guide bars.

8. The printing web position adjusting apparatus according to claim 5, wherein central portions of said two guide bars are hollow and are provided with small holes reaching hollow portions thereof at outer peripheral faces thereof on which the printing web is made to wrap, further comprising an air supplier that supplies compressed air to said hollow portions of said guide bars.

9. The printing web position adjusting apparatus according to claim 5, further comprising a moving bracket on each end of at least one of said two guide rollers and screw shafts for reciprocally moving said brackets and said at least one of said two guide rollers therewith in a direction parallel to the traveling direction of the printing web.

10. The printing web position adjusting apparatus according to claim 5, wherein each said separate angular movement center includes a first pin on a first end of each said guide bar, each said first pin mounted in a stationary bracket, and said mover that angularly moves said two guide bars includes a second pin on a second end of each said guide bar, and a moving piece attached to each said second pin, wherein each said moving piece is slidable in a moving bracket so that as said moving pieces slide, said guide bars move angularly around said separate angular moving centers.

* * * * *